United States Patent [19]

Guy et al.

[11] Patent Number: 4,481,722

[45] Date of Patent: Nov. 13, 1984

[54] SYSTEM FOR PROTECTING A ROTARY DRYER FROM THERMAL STRESS

[75] Inventors: Fredrick A. Guy, Appleton, Wis.; Robert S. Ball, Etobicoke, Canada

[73] Assignee: Kimberly-Clark Corporation, Neenah, Wis.

[21] Appl. No.: 391,368

[22] Filed: Jun. 23, 1982

[51] Int. Cl.[3] ..... F26B 13/08

[52] U.S. Cl. ..... 34/47; 34/54; 34/86; 34/115

[58] Field of Search ..... 34/54, 48, 47, 49, 114, 34/115, 116, 122, 123, 86; 432/222, 4, 35, 57

[56] References Cited

U.S. PATENT DOCUMENTS

| | | | |
|---|---|---|---|
| 3,021,607 | 2/1962 | Fleissner | 34/115 |
| 3,849,904 | 11/1974 | Villalobos | 34/155 |
| 4,103,434 | 8/1978 | Walker | 34/114 |
| 4,231,165 | 11/1980 | Gresens | 34/86 |
| 4,326,342 | 4/1982 | Schregenberger | 34/47 |
| 4,328,626 | 5/1982 | Leitner | 34/115 |
| 4,343,096 | 8/1982 | Bergland | 34/48 |

*Primary Examiner*—Larry I. Schwartz

*Attorney, Agent, or Firm*—Gregory E. Croft

[57] ABSTRACT

A system for drying a wet web of fibrous material carried through a rotary dryer on an air pervious support, without damage to the rotary dryer or the air pervious support in the event of an upset to the system comprising in combination (1) heater means for producing hot air; (2) a dryer unit, (3) an air mixer or heat exchanger for providing hot air at the desired temperature to the input section of the dryer; (4) recycle means for carrying air exiting the air output section of the dryer unit to the air mixer or heat exchanger; (5) a first line for carrying the hot air from the heater means to the air mixer or heat exchanger; (6) a first normally open damper means on the first line; (7) a second line for venting hot air away from the system; and (8) a second normally closed damper means on the second line, wherein when an upset in the system occurs, the hot air produced by the heater means and normally carried to the air mixer or heat exchanger is vented away from the system by opening the second normally closed damper means on the second line and closing the first normally open damper means on the first line.

7 Claims, 2 Drawing Figures

SYSTEM FOR PROTECTING A ROTARY DRYER FROM THERMAL STRESS

BACKGROUND OF THE INVENTION

Field of the Invention

This invention relates generally to a system for the drying of a wet web of fibrous material on a rotary dryer. More specifically it relates to the control of the input of the hot air used in a drying system to protect (1) the rotary dryer from thermal stress caused by sudden temperature changes and (2) the air pervious support carrying the web through the dryer from high temperatures which can damage or destroy it.

In a throughdrying system operating with air heated to temperatures of 400° F. and higher, the loss of the wet web during the drying step can (1) cause severe thermal stress to the metal parts of the dryer, specifically to the air pervious rotating cylindrical surface of the dryer, and (2) melt the traveling air pervious support, e.g., a polyester carrier fabric.

The result of either of these events can be catastrophic. In the case of thermal stress to the metal surfaces of the dryer, the result can be the distortion or even the rupture of the cylindrical surface resulting in a major shutdown until the dryer can be replaced or the surface restored.

In the case of a melted support, replacement will be required due to the sealing off of portions of the support rendering it unsuitable for use; and in the more severe case where the support is severely melted, the result can be severe sticking to the exterior cylindrical, air pervious surface of the rotating drum, clogging the surface. Again, a major shutdown—in this situation to clean out the dryer surface—is required.

Conventional temperature control systems tend to be slow acting. For this reason they are unsatisfactory when confronted with the need for an immediate response to prevent damage such as described above. Systems are also presently available which rely on water sprays, turning the burner down or turning the burner off to protect the air pervious support. However, water sprays can cause high levels of thermal stress for the dryer and can also wrinkle the air pervious support; turning the burner off requires that the complete system be cooled to allow purging prior to relighting. A system then which will avoid these problems and provide a rapid response time is highly desirable. Ideally, the system should also allow testing, start-up and trouble shooting of the dryer without subjecting either (1) the exterior cylindrical, air pervious surface of the dryer or (2) the air pervious support, to air heated to excessively high temperatures.

The subject invention is directed then to a system for overcoming or minimizing the difficulties described above when upsets occur in the drying system which could lead to thermal stress of the dryer itself and/or heat damage to the air pervious support carrying the web of fibrous material through the dryer. Additionally, this invention is directed to a system wherein during start-up, trouble shooting and testing, the heater means can be fired independently of the air system.

SUMMARY OF THE INVENTION

The subject invention is directed to a system for air drying a wet web of fibrous material while providing for the protection of the air pervious support for the web and the dryer against thermal upsets occurring in the system. These upsets can result in the dryer, particularly the exterior cylindrical, air pervious surface of the rotating drum, being subjected to thermal stress. A sudden change in temperature can result in distortion or rupturing of the rotating drum. High temperatures can destroy the air pervious support by melting it.

One embodiment of this invention is a system providing in combination: a heater means for producing hot air; a dryer unit comprising (a) an air input section having a supply hood partially enclosing the exterior, air pervious, cylindrical surface of a rotatable drum which carries the air pervious support for the paper web and (b) an air output section, the dryer unit so constructed and arranged as to dry the web by passing hot air through the web, then through the support and then through the cylindrical surface of the rotating drum in a transpiration dryer section; an air mixer for mixing a portion of the exhaust air exiting the air output section with the hot air produced in the heater means to (1) adjust the temperature of the heated air which is supplied to the air input section of the dryer by the air mixer and (2) utilize the heat of the air exiting the dryer thereby reducing the load on the heater means and improving the economy of the system; recycle means for carrying at least a portion of the exhaust air exiting the air output section of the dryer unit back to the air mixer; a first line for carrying hot air from the heater means to the air mixer; a normally open damper means on the first line; a second line for venting hot air from the heater means away from the system; and a second normally closed damper means on the second line.

Upon the onset of an upset in the system, the hot air from the burner means, which is normally carried to the air mixer for mixing with at least a portion of the exhaust air, is vented away from the system before reaching the air mixer by opening the normally closed damper means on the second line and closing the normally open damper means on the first line. In this manner the time and degree of increased temperature experienced by the air pervious support and the exterior cylindrical, air pervious surface of the rotating drum are minimized thereby reducing thermal stress in the rotary dryer and damage to the air pervious support.

The degree of temperature rise is further limited by minimizing the system volume between the air mixer and the supply hood in the dryer unit. This coupled with isolating the heater means and activating the dampers referred to above serves to minimize thermal stress and maintain the dryer at a relatively constant temperature. Preferably the system volume between the air mixer and the supply hood is less than 25 volume % of the total recirculation air system volume when recycled air continues to circulate through the system. In this manner the recycled air rapidly reduces the temperature of the residual air in the air mixer and precludes an undesirable quick temperature rise. Alternatively, the flow of recycle air to the air mixer and then to the supply hood can be stopped by closing a damper in the recycle line. By this approach, the flow of all air to the dryer is stopped since the hot air from the burner is vented to the atmosphere and the recycle air flow has ceased.

As an alternative system, an air-to-air heat exchanger can be used, e.g., with dirty fuels. In this alternative the heat exchanger replaces the direct air mixer and in the event of an upset the hot air generated by the off-line burner means is similarly vented to the atmosphere prior to reaching the heat exchanger. Again, the system volume is preferably constrained to limit the volume between the heat exchanger and the supply hood to less than 25 volume % of the air circulation system when recycled air continues to circulate through the system.

DESCRIPTION OF THE PREFERRED EMBODIMENTS

Figure 1:
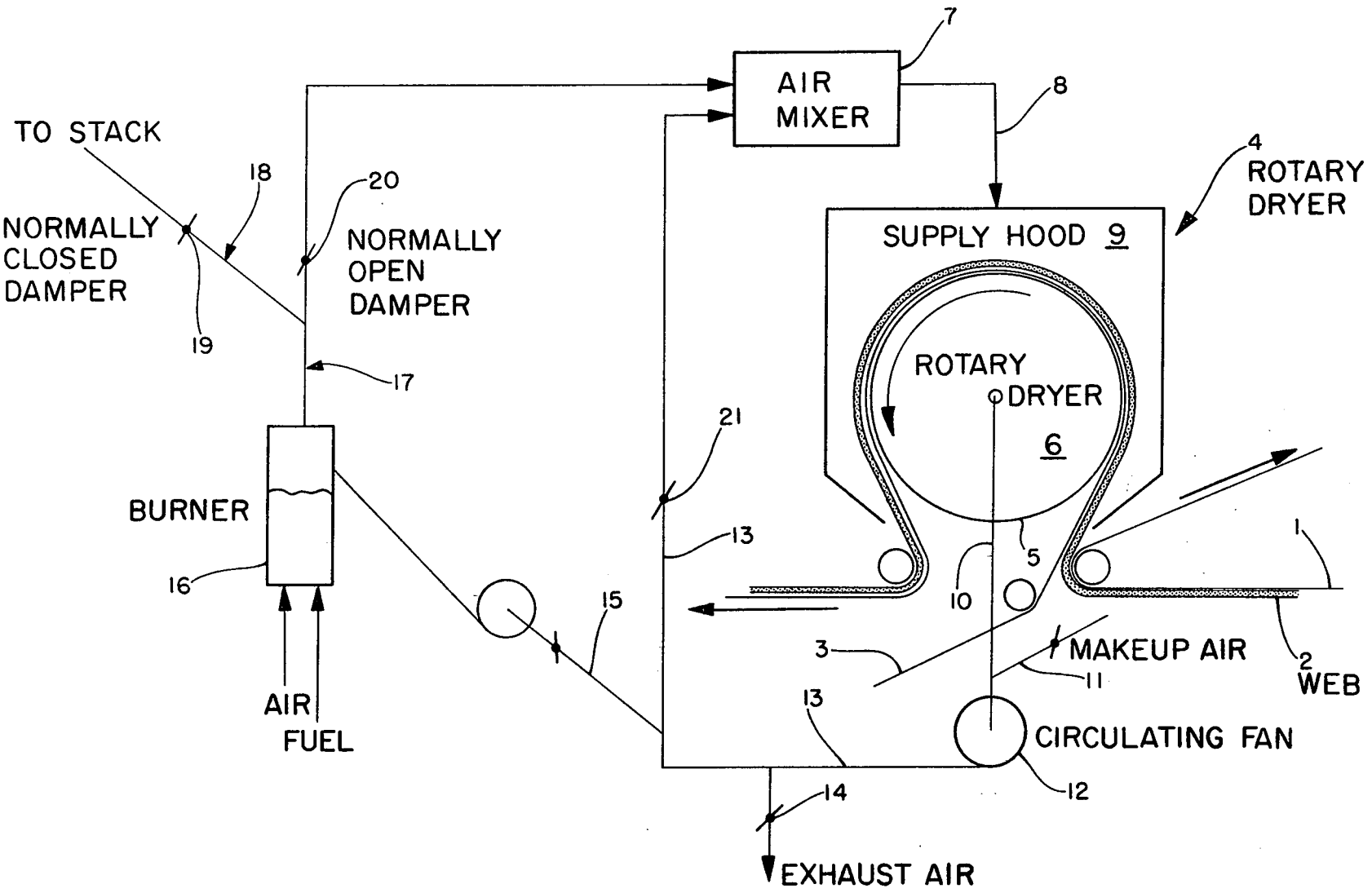
FIG. 1 is a schematic illustration of one embodiment of the system of this invention wherein a burner is used to generate hot air which is supplied directly to the dryer after being mixed with recycled air.

It is believed that the subject invention may be best understood by consideration of the system schematically illustrated in the drawings when (1) the systems are in normal operation and (2) when upsets occur in the systems, such as a loss of the web being dried. With this in mind, and considering the system of FIG. 1 first, in normal operation a forming fabric 1 carries a wet web of fibrous material 2 to a carrier fabric 3 which transports the web through a rotary dryer generally depicted at 4, on the exterior, air pervious, cylindrical surface 5 of a rotating drum 6. Air from the air mixer 7 is provided via line 8 to supply hood 9 which partially encloses the exterior surface of the rotating drum.

The hot air passes through the wet web 2, through the carrier fabric 3 and then through the air pervious cylindrical surface 5 of the rotating drum 6 thereby drying the wet web to a typical fiber consistency of from about 80 to about 95% compared with the 20 to 25% fiber consistency typical of the web as it enters the rotary dryer.

After hot air from air mixer 7 passes through the web 2, the carrier fabric 3 and the surface 5 of the rotating drum, the cooled exhaust air is removed via recycle line 10, makeup air is added as required via line 11 and the combination is recirculated by circulating fan 12 and recycle line 13 (recycle lines 10 and 13 and circulating fan 12 making up the recycle means for this embodiment of the invention) to the air mixer 7. By way of illustration the amount of makeup air added may typically be in the range of from 5 to 15 volume % of the exhaust air exiting the dryer via line 10 and will typically be at about ambient conditions, that is circa 70° F. Alternatively, the makeup air can be preheated by air/air heat exchange with the exhaust air.

Downstream of circulating fan 12 a portion of the mixture of the exhaust air and the makeup air is drawn off at line 14 to remove (water vapor) moisture from the system. Typically the amount drawn off at this point will be in the range of from 5 to 25%, more typically about 15% by volume of the air passing this point. Again by way of illustration, the temperature of the exhaust air exiting the dryer via line 10 typically may be in the range of from about 200 to about 325° F. The air leaving the circulating fan 12 after the addition of makeup air typically may be in the range of about 200°–250° F., more typically about 225° F. Of the recycle and makeup air remaining after a portion has been vented out of the system at line 14, on the order of 10 volume % of this air is sent via line 15 to the burner 16 just downstream of the combustion zone. In this manner the combustion air leaving the combustion zone of the burner 16 at a temperature typically in the range of from about 2800°–3500° F., more typically 3000° F., is reduced to about 1200° F. This hot air—the term air is used throughout here albeit the gaseous products exiting the burner via line 17 might also be described as hot combustion gases or the like—is then sent via line 17 to the air mixer 7 where it is mixed with recycle air from line 13 in a volume ratio of about one volume of the 1200° F. air from the burner to about 5 volumes of the 225° F. recycle air to provide mixed air having a temperature in the range of from about 400°–450° F. This mixed air is then sent as previously described to the supply hood 9 via line 8.

This is the normal mode of operation of the system illustrated in FIG. 1. The system includes other elements which come into operation when an upset occurs in the system. To illustrate the subject invention when an upset to the system occurs, assume that the wet web 2 is lost upstream of the rotary dryer. In the absence of some form of control to avoid temperature increases, and even with the use of slow-reacting conventional or standard temperature controllers, the following will occur: (1) the carrier fabric will very quickly encounter temperatures as high as at least 425° F., i.e., the temperature of the input air coming from the air mixer 7 via line 8 since there is no longer a wet web from which moisture is being evaporated thereby reducing the temperature of the air contacting the carrier fabric; (2) in like manner the cylindrical surface of the rotating drum will be subjected to temperatures in the neighborhood of 425° F. for the same reason; (3) the temperature of the air exiting the throughdryer via line 10 and which is then recycled to the air mixer 7 via line 13 will rapidly increase up to a temperature in the range of from about 350°–375° F. since there is no thermal drain on the air by virtue of the drying process normally occurring in the wet web; (4) the air mixer will be confronted with a mixture of about one volume of about 1200° F. and progressively higher temperature air from the burner, and about 5 volumes of about 375° F. recycle air from the dryer 4; and (5) the air mixer 7 will then provide a stream of air to the supply hood 9 which has a temperature rapidly approaching 500° F.

The result is that in a very short time frame the temperature of the carrier fabric and the dryer rises from about 425° F. to about 500° F. and then continues to rapidly climb as increased energy is put into the system by burner 14 without any concomitant thermal drain on the system by virtue of the evaporation of water from the wet web. The result is thermal stress to the throughdryer including the possibility of distortion of the exterior, air pervious cylindrical surface of the rotating drum and damage to, if not total destruction of, the carrier fabric.

Since desirably the system is operated at as high a temperature as possible for increased throughput rates, the desirability of a system providing substantial immediate control of temperature at the onset of any upset in the system is manifest. Failure to quickly control the temperature of the air entering the supply hood can result in catastrophic losses including lost production time, the cost associated with replacing an expensive carrier fabric and, in an extreme situation, replacement of the rotary drum. The situation is even more severe when operating with air inlet temperatures to the supply hood approaching 450° F. since the polyester carrier fabrics typically used in rotary dryers of this type melt at about 450° F.

To minimize the temperature increase and the time of any such increase that does occur, the subject invention provides the following:

Referring to FIG. 1 a line 18 having a damper 19 thereon leads to a venting system, e.g., a stack. Upon the detection of the onset of an upset the damper 19 which is normally closed is opened. Simultaneously or as quickly thereafter as possible, damper 20 on line 17, which is normally open during operation of the dryer, is closed. The combination of these two steps together with the design configuration of the air mixer and supply hood effectively limits the input into the system of any substantial volume of hot air which could cause damage to the carrier fabric on the rotary dryer. The rapid activation of the dampers 19 and 20 limits the addition of further hot air into the system and, of course, acts much faster then a conventional temperature controller controlling burner settings. Additionally, the system is preferably designed such that the volume of hot air between the air mixer 7 and the supply hood 9 is less than 25% of the total volume of the air circulation system, i.e., the air mixer 7, the supply hood 9, the interior of the rotary dryer and all lines in the air circulating system when dampers 19 and 20 are activated on the occurence of an upset, that is lines 8, 10 and 13 (lines 10 and 13 and circulating fan 12 making up the recycle means for this system).

In addition to the steps described immediately above, the dumping of exhaust air from the system via line 14—normally for the purpose of removing water vapor from the system—can be increased and the amount of makeup air entering the system via line 11 increased to further reduce the temperature of the recycle air being fed to the air mixer 7 via the recycle line 13.

The result of the above steps and the design configuration of this system is such that the temperature rise is minimal when the volume of higher temperature air between air mixer 7 and the supply hood 9 is diluted with the balance of the lower temperature air in the system.

As an alternative to increasing the rate of addition of makeup air and the rate of removal of exhaust air, the flow of air to the hood can be stopped by, for instance, putting a normally open damper means 21 on recycle line 13 which is closed in sequence after the opening of normally closed damper 19 and the closing of normally open damper 20. If this alternative is utilized the fan providing makeup to the system through line 11 should preferably be shut off.

The direct air heated system described above in conjunction with FIG. 1 is highly desirable when clean fuels are available, e.g., natural gas. This configuration is obviously less desirable when the heat source is not clean burning, e.g., powdered coal, high sulpher oil, bunker oil or the like, since these fuels may introduce incomplete combustion products such as carbon and soot into the wet web.

Figure 2:
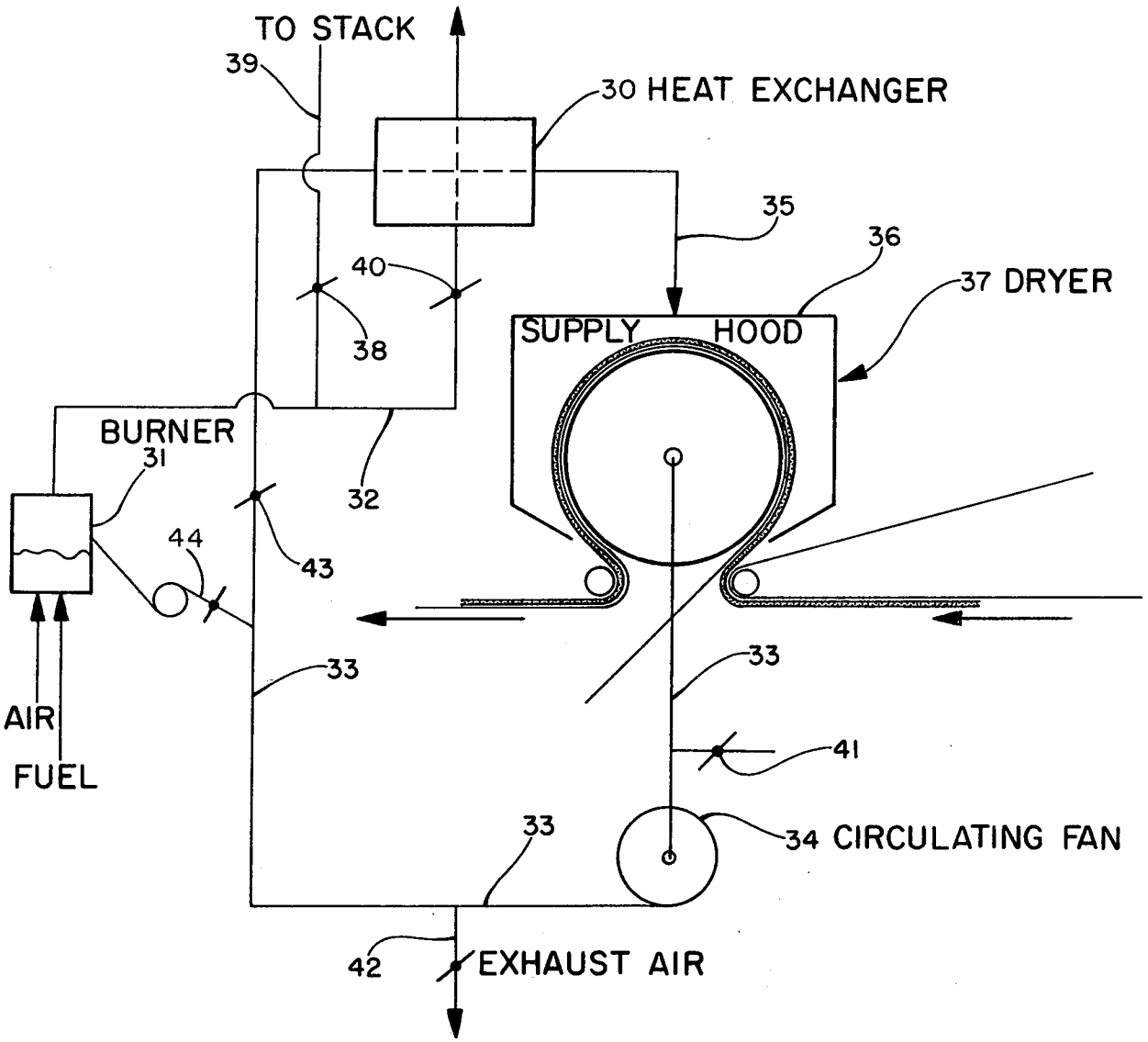
FIG. 2 is a schematic illustration of an alternative embodiment of the system of this invention wherein a heat exchanger is used to indirectly supply hot air to the dryer by heating recycled air in an air/air heat exchanger.

When dirty fuels are all that are available, the system schematically illustrated in FIG. 2 is preferred. This system while similar to that shown in FIG. 1, utilizes a heat exchanger 30 so that high temperature but dirty combustion gases from the burner 31 are provided via the line 32 to the air-to-air heat exchanger 30, thereby heating recycled air introduced into the heat exchanger via recycle line 33 - recycle line 33 and the circulating fan 34 therein making up the recycle means for this embodiment of the invention. This recycled air, heated to the desired temperature in the heat exchanger 30, is then carried via line 35 to the supply hood 36 of the dryer 37.

In the event of a loss of the wet web or other upset in the system, the normally closed damper 38 on the vent line 39 is opened thereby venting the supply of the hot air combustion gases away from the system. Simultaneously, or as quickly thereafter as possible, the normally open damper 40 on line 32 is closed thereby cutting off the input of any additional hot combustion gases to the heat exchanger. Additionally, the rate of addition of makeup air via line 41 can be increased and the rate of removal of exhaust air via line 42 can be increased to further reduce the temperature of the recycle air being fed to the heat exchanger 30 via the recycle line 33.

As an alternative to increasing the rate of addition of makeup air and the rate of removal of exhaust air, the flow of air to the hood can be stopped by, for instance, putting a normally open damper means 43 on the recycle line 33 which is closed contemporaneously with the opening of the normally closed damper 38 and the closing of the normally open damper 40. If this alternative is utilized, the fan providing makeup air to the system through line 41 should preferably be shut down. The air being fed to the burner 31 just downstream of the combustion zone by line 44 to reduce the temperature of the hot air coming out of the combustion zone is, of course, maintained—as it is in the system described in FIG. 1—while the burners are operating at normal levels to insure that the hot air exiting the combustion zone is not carried through the piping system at excessively high temperatures. And, the burners in both the systems of FIGS. 1 and 2 are desirably turned down when an upset occurs. The subject invention, however, does not require either the turning down or, less desirably, the turning off of the burner since the hot air from the burner is vented away from the system.

By all of these techniques, the build up of the temperature of the hot air supplied to the dryer hood is held in check. As in the system described in FIG. 1, the volume of the system from the heat exchanger 30 to the supply hood 36, i.e., line 35, is kept as small as feasible to reduce the amount of air which must be cooled by the remainder of the air in the system; preferably to less than 25 volume % of the total volume of the air circulation system formed by the supply hood 36, the interior of the dryer 37, the heat exchanger 30 on the heated air side and all lines in the air circulation system when dampers 38 and 40 are activated on the occurrence of an upset, that is lines 33 and 35 (line 33 and the circulating fan 34 making up the recycle means for this system).

As previously discussed, a further advantage of this invention is that the burner can be fired completely independently of the dryer air system. This is particularly useful for start-up situations, testing and trouble shooting.

As can be seen in the foregoing description, the system of the present invention provides a method for controlling the increase in temperature in a throughdryer experienced when an upset to the system occurs. Not only is the degree or level of temperature increase minimized, the time of any increased temperature exposure of the rotating drum and the air pervious support, e.g., a polyester carrier fabric, is minimized. While the invention has been described in connection with preferred embodiments, it should be understood that it is not intended to limit the invention to those embodiments. On the contrary, it is intended to cover all alternatives and equivalents as may be included in the spirit and scope of the invention. For example, the subject invention can be used in rotary dryers in which an impingement dryer section is used ahead of the transpiration dryer section.

As a further alternative, the subject invention is useful with rotary dryers where the web is carried through the dryer supported on a sleeve rather than a traveling air pervious support carrying the web through the dryer, e.g., on a stainless steel mesh sleeve encircling the exterior, air pervious, cylindrical surface of the rotatable drum of the rotary dryer. In this instance, there is no air pervious support present requiring protection against high temperatures but the rotary dryer must still be protected against sudden temperature changes.

What is claimed is:

1. A system for drying a wet web of fibrous material carried through a rotary dryer on an air pervious support, without damage to the rotary dryer or the air pervious support in the event of an upset to the system, comprising in combination: (1) heater means for producing hot air; (2) a dryer unit comprising (a) an air input section having a supply hood partially enclosing the exterior, air pervious, cylindrical surface of a rotatable drum which carries said support and (b) an air output section, said dryer unit so constructed and arranged as to dry said web by passing hot air through said web, then said support and then said cylindrical surface in a transpiration dryer section; (3) an air mixer for mixing at least a portion of the air exiting said air output section with the hot air produced in said heater means and supplying the mixture of air to said air input section; (4) recycle means for carrying at least a portion of the moist air exiting said air output section of said dryer unit to said air mixer, said recycle means including (a) an outlet for moist exhaust air; (b) an inlet for make-up air; and (c) an outlet for directing a portion of the moist air to said heater means; (5) a first line for carrying said hot air from said heater means to said air mixer; (6) a first normally open damper means on said first line; (7) a second line for venting said hot air away from the system; and (8) a second normally closed damper means on said second line, and wherein upon the onset of an upset in said system, the hot air produced by said heater means and normally carried to said air mixer for mixing with said portion of the air exiting said air output section can be vented away from the system by opening said second normally closed damper means on said second line and closing said first normally open damper means on said first line, thereby minimizing the time and degree of increased temperature experienced by said support and said cylindrical surface of said rotatable drum as a result of said upset.

2. The system of claim 1 wherein the system volume between said air mixer and said supply hood is less than 25 volume % of the total volume of the air circulation system.

3. The system of claim 1 further comprising a third normally open damper means located on said recycle means whereby the flow of air to said air mixer via said recycle means can be stopped by closing said third damper means contemporaneously with the opening of said second normally closed damper means and the closing of said first normally open damper means.

4. A system for drying a wet web of fibrous material carried through a rotary dryer on an air pervious support, without damage to the rotary dryer or the air pervious support in the event of an upset to the system, comprising in combination: (1) heater means for producing hot air; (2) a dryer unit comprising (a) an air input section having a supply hood partially enclosing the exterior, air pervious, cylindrical surface of a rotatable drum carrying said support and (b) an air output section, said dryer unit so constructed and arranged as to dry said web by passing hot air through said web, then said support and then said cylindrical surface in a transpiration dryer section; (3) an air-to-air heat exchanger for heating at least one portion of the air exiting said air output section with the hot air produced in said heater means and supplying the so heated air to said input section; (4) recycle means for carrying at least a portion of the moist air exiting said air output section of said dryer unit to said heat exchanger, said recycle means including (a) an outlet for moist exhaust air; (b) an inlet for make-up air; and (c) an outlet for directing a portion of the moist air to said heater means; (5) a first line for carrying said hot air from said heater means to said heat exchanger; (6) a first normally open damper means on said first line; (7) a second line for venting said hot air away from the system; and (8) a second normally closed damper means on said second line, and wherein upon the onset of an upset in said system the hot air produced by said heater means and normally carried to said heat exchanger for heating at least a portion of the air exiting said air output section of said dryer unit can be vented away from the system by opening said second normally closed damper means on said second line and closing said first normally open damper means on said first line, thereby minimizing the time and degree of increased temperature experienced by said support and said cylindrical surface of said rotatable drum as a result of said upset.

5. The system of claim 4 wherein the system volume between said heat exchanger and said supply hood is less than 25 volume % of the total volume of the air circulation system.

6. The system of claim 4 further comprising a third normally open damper means located on said recycle means whereby the flow of air to said heat exchanger via said recycle means can be stopped by closing said third damper means contemporaneously with the opening of said second normally closed damper means and the closing of said first normally open damper means.

7. The system of any of claims 1 to 6 wherein said dryer unit further comprises an impingement dryer section ahead of said transpiration dryer section.

* * * * *